US005615783A

United States Patent [19]

Warnken

[11] Patent Number: 5,615,783

[45] Date of Patent: Apr. 1, 1997

[54] PORTABLE FOLDING SADDLE RACK

[76] Inventor: Dwight C. Warnken, 1750 Wapity View Rd., Deer Lodge, Mont. 59722

[21] Appl. No.: 544,586

[22] Filed: Oct. 18, 1995

[51] Int. Cl.[6] ..... A47F 7/00

[52] U.S. Cl. ..... 211/118

[58] Field of Search ..... 211/118, 86, 87, 211/104, 113

[56] References Cited

U.S. PATENT DOCUMENTS

| | | | |
|---|---|---|---|
| 557,732 | 4/1896 | Wade . | |
| 1,189,677 | 4/1916 | Farlese . | |
| 2,500,881 | 3/1950 | Stader . | |
| 3,476,255 | 11/1969 | Cianco . | |
| 3,780,971 | 12/1973 | DeFilipps . | |
| 3,847,286 | 11/1974 | Garrett . | |
| 4,541,535 | 9/1985 | Bartholomew . | |
| 5,014,948 | 5/1991 | Asaro et al. | 211/86 X |

FOREIGN PATENT DOCUMENTS

| | | |
|---|---|---|
| 693656 | 11/1930 | France . |
| 286455 | 3/1928 | United Kingdom . |

*Primary Examiner*—Alvin C. Chin-Shue
*Assistant Examiner*—Sarah L. Purol
*Attorney, Agent, or Firm*—Richard C. Litman

[57] ABSTRACT

A saddle rack usable in a portable mode includes a framework of elongated tubular elements presenting a top member having hanger elements engageable with various available structures such as fence rail and the like and from which is suspended one or more hanger arms each in turn joined at its lower end to a saddle support arm provided with a top cover of curved configuration adapted to nest within the longitudinal groove existing beneath saddle seats. Optimum compactibility is achieved during collapsing of the rack through pivot assemblies joining the top member, hanger arm and saddle support arm together and whereupon the saddle support arm is foldable in an upward plane normal to a vertical plane passing through the top member, following which the combined saddle support arm and hanger member are in turn are pivoted together to a line parallel and juxtaposed the top member. One or more hooks depending from the top member provide hanger elements for receiving associated equestrian accouterments. Alternatively, an additional hanger arm and saddle support arm may be affixed to the top member to accommodate a second saddle with the single rack device.

14 Claims, 3 Drawing Sheets

18
28
82
78
58
76
44
54
60
48
50
64
56
60
52
46
48
40
62
80
42
82

PORTABLE FOLDING SADDLE RACK

BACKGROUND OF THE INVENTION

1. Field of the Invention

This invention relates generally to equestrian appliances, and more particularly to an improved saddle rack, readily collapsible into a most compact condition and, when erected, adaptable to be supported upon various available structures existing around stable, barnyard or corral environments.

2. Description of the Prior Art

The problem of how to properly care for horse saddles is foremost in a horseman's mind, whether involving a utility saddle, general riding saddle or saddles as used for racing or exhibition horse shows. Such concern is supported not only by the significant cost of any one saddle but also due to the obvious attachment any horseman has for every saddle in their inventory. Accordingly, great care must be exercised, not only in the use of but just as importantly, in the care and storage of every saddle when not being used on a horse. At one's home stable, the dilemma is readily taken care of since suitable storage provisions are made available in the stable and tack room but, whenever riding horses are trailered to activities at other locations, proper facilities for the care of saddles are rarely available. Thus the need exists for suitable portable means for the support or storage of saddles when one is on the road.

Portable and/or collapsible saddle racks per se are well known however many fall far short of meeting all of the requirements sought in such devices. An ideal saddle rack of this type should be extremely simple in construction, be readily adaptable to mounting upon or hanging from usually available structures and be very compact when folded or collapsed so that it will readily fit within traveling tack boxes. Additionally, a portable saddle rack should lend itself to provisions for accommodating more than one saddle as well as allowing for the support of associated tack such as harnesses, bridles or halters.

French Patent No. 693,656 dated Nov. 24, 1930 discloses a portable support device which, although not particularly adapted to receive saddles, does show a pair of hanger members for attachment to a structure such as a door top and which includes a pair of hook elements carried on a collapsible frame structure. Unlike the present invention, this prior art device has no provision enabling the support of a saddle.

U.S. Pat. Nos. 557,732, 1,189,677 and 2,500,881 issued to Wade, Farlese and Stader on Apr. 7, 1896, Jul. 4, 1916 and Mar. 14, 1950 respectively, each illustrates an example of portable racks or holders for diverse elements and includes adjustability features but all of these devices lack the provision of extended arm(s) capable of properly supporting a saddle(s) as well as the instant teaching of a unique folding action to achieve a most compact, collapsed elongated configuration.

A support apparatus specifically intended for saddles will be found in U.S. Pat. No. 3,476,255 issued Nov. 4, 1969 to Ciancio and illustrates a horizontal bar supported by a tripod assembly with movable arms on the bar adapted to support a saddle. This type of support is designed to be used where an obviously substantially flat or even ground surface exists and as is well known to those experienced in the art, such flat surfaces as offered by a concrete floor are rare in the field where a portable saddle support is desired. The present invention, on the other hand, offers a hanging rack assembly that is easily accommodated by the rails, fences, walls, etc. so prevalent in stables, corrals, pickup truck side walls and the like.

Another saddle rack as shown in U.S. Pat. No. 3,780,971 issued to De Filipps on Dec. 25, 1973 allows support of a single saddle and although collapsible, still presents a folded condition of substantial width, unlike the instant development wherein all of the principal components comprise square tubing and shifting to a folded mode is accomplished by movement of these components in two planes to achieve a most compact condition, suitable for storage within a portable tack box.

U.S. Pat. No. 3,847,286 issued to Garrett on Nov. 12, 1994 depicts a hanger device and although not adaptable for supporting a saddle, shows the concept of a horizontal member from which two elements are suspended for supporting, in this case, a pair of lanterns. This prior art device departs from the instant proposal wherein one or two support arms are folded downwardly from a storage position to accommodate a saddle(s).

The saddle rack disclosed in U.S. Pat. No. 4,541,535 issued Sep. 17, 1985 to Bartholomew illustrates a single vertical rod supporting a pivotal saddle support element and wherein the vertical rod is provided with end formations removably attachable to a pair of brackets permanently affixed to a wall surface. This construction is unlike that taught herein, wherein total portability is achieved with a unitary assembly comprising foldable elongated elements which may be collapsed in two planes and when unfolded, is removably attachable to many existing structures without any disparate brackets or the like.

None of the above inventions and patents, taken either singly or in any combination, is seen to even remotely suggest or describe the instant invention as claimed herein.

SUMMARY OF THE INVENTION

By the present invention an improved saddle rack is offered wherein the principal components comprise elongated, rectangular tubing including a horizontal top member having a pair of hanger elements for suspending the rack from any suitable available structural member such as a fence rail, low stable wall or truck body side wall. One or more hanger arms are pivotally suspended from the top member and are swingable in the plane of the top member to allow folding into a position juxtaposed the top member, throughout its length. The lower, free end of the hanger arm carries a retention bracket to which in turn is pivotally connected a saddle support arm, with the bracket allowing the saddle arm to be swung in an outward plane, between a folded position juxtaposed the hanger arm, to a use position normal thereto. A saddle protective member overlies the saddle arm and is configured to nest within the longitudinal groove existing along the underside of saddles, while a plurality of hanger devices are suspended from the top member to accommodate any of various equestrian accouterments such as halters, harness devices, etc.

Accordingly, one of the objects of the present invention is to provide an improved portable folding saddle rack including a plurality of elongated members pivotally attached to one another and collapsible to form an extremely compact, storage condition.

Another object of the present invention is to provide an improved portable folding saddle rack including a framework of tubular, articulated elements which are manipulated in a swinging manner in two planes to achieve a folded or use position.

A further object of the present invention is to provide an improved portable folding saddle rack including a plurality of tubular elements of rectangular cross-section with one or more lower arms shiftable to a horizontal use position and having a top, horizontal member provided with both hanger devices capable of supporting the assembly from a fence, wall or the like, as well as depending hook devices from which accessory elements may be hung.

Still another object of the present invention is to provide an improved portable folding saddle rack including a topmost horizontal member supportable from an existing structure and from which depend one or more pivotally attached hanger arms each in turn supporting a retention bracket having an outwardly swingable saddle support arm pivotally secured thereto.

Another object of the present invention is to provide an improved portable folding saddle rack including one or more elongated saddle support arms pivotally joined to a suspended hanger arm with each support arm comprising a narrow element provided with a topmost member defining a curved crown having a low coefficient of friction and adapted to nest within the groove existing along the centerline of a saddle underside.

These and other objects of the present invention will become readily apparent upon further review of the following specification and appended claims.

BRIEF DESCRIPTION OF THE DRAWINGS

Similar reference characters designate corresponding parts throughout the several figures of the drawings.

DETAILED DESCRIPTION OF THE PREFERRED EMBODIMENTS

Figure 1:
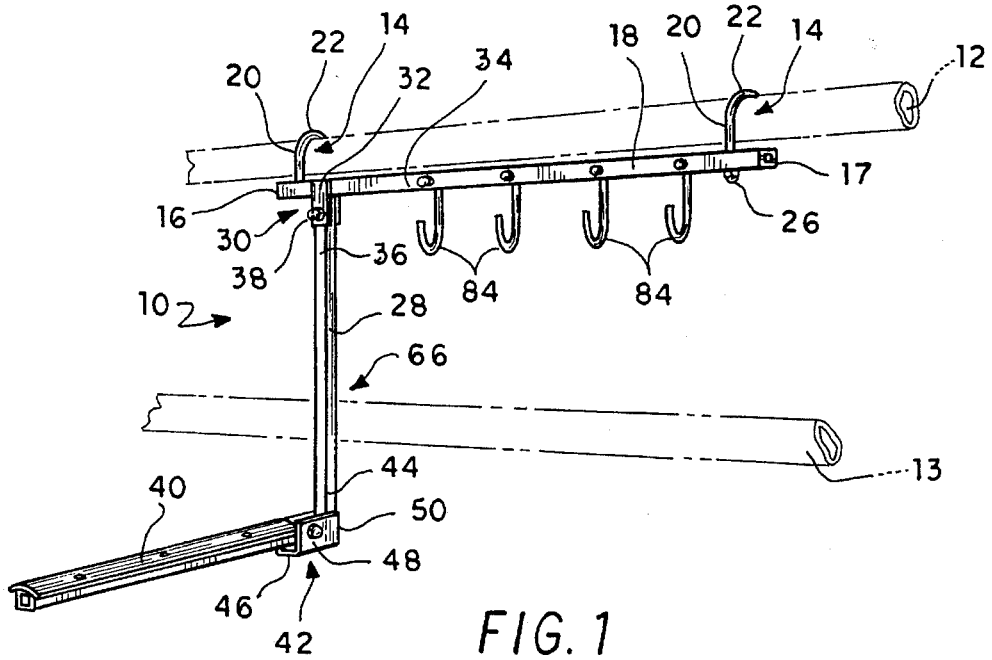
FIG. 1 is a front perspective view of the saddle rack of the invention as it appears in the unfolded, in use position.

Referring now to the drawings, particularly FIG. 1, the present invention will be seen to include a saddle rack, generally designated 10 and which is constructed primarily of a plurality of elongated members comprising square or rectangular tubing. These components are preferably made of aluminum or steel and for weather protection, may be anodized or galvanized, respectively.

The rack 10 is adapted to be supported from any available existing structure to which a user may have access. Since the rack is intended primarily to be used when the horseman is traveling away from their home stable, this means that often the comforts and features of a stable may not be available. However, with the present apparatus, which is conveniently transported within a portable or traveling tack box, the rack 10 may be readily suspended from any of many usually available structures including a fence or corral rail 12 or a truck side wall. This is accomplished by means of a pair of hanger elements 14-14 affixed adjacent the ends 16-17 of the horizontal top member 18. The hanger elements 14 include a vertical shank portion 20 joined to a curved top portion 22 and are akin to approximately ¾ of a U-bolt of well known construction. The threaded end 24 (see FIG. 3) of the shank portion 20 passes through the top member 18 and is capped with an acorn nut 26. The hook-like hanger elements 14 may be fixedly secured in the position shown in the drawings, or alternatively may be loosely affixed thereto. The latter arrangement will allow for further compaction of the assembly when in the collapsed, storage condition and the hanger elements 14 may then be swung 90 degrees and oriented parallel with the top member 18. The use of acorn nuts 26 throughout the assembly of the rack 10 will be understood to offer two desirable features. First, the threaded ends of the various threaded elements are protected from corrosion and secondly, the rough edges or burrs of exposed threads are enclosed, presenting a rounded protective shield discouraging the snagging or scuffing of saddle parts or a user's clothing. Additionally, acorn nuts are readily available with built-in lock-nut elements, further enhancing the retention thereof.

Depending from the top member 18, inside the two hanger elements 14-14, is at least one hanger arm 28, preferably of the same rectangular configuration as the top member 18. This arm 28 is suspended by means of a hanger arm mount 30 comprising a pair of mount plates 32-32 (see FIGS. 3–4) welded or otherwise affixed to the sides 34 of the top member 18. In this manner, the upper end 36 of the hanger arm 28 is sandwiched between the two plates 32-32 and will be seen to be pivotally connected thereto by means of a threaded fastener assembly 38. It will be understood that the arm 28 is freely suspended in the view of FIG. 1 and normally assumes the illustrated vertical position due to gravity but is capable of being manually shifted upwardly, within the vertical plane of the top member 18.

To retain the saddle support arm 40, a retention bracket 42 comprising a generally U-shaped member, is suitable affixed, such as by welding, to the lower end 44 of the hanger arm 28. This bracket 42 includes a horizontal bottom wall 46 joined to two upright side walls 48-48 with its inner end 50 secured to the hanger arm lower end as shown most clearly in FIG. 4 of the drawings. From this latter drawing view it will be most clearly seen that a limit block 52 is disposed within the cavity 54 of the retention bracket 42, adjacent the bracket outer end 56, for reasons which will become obvious hereinafter. It is within this cavity 54 that the inner end 58 of the saddle support arm 40 is pivotally disposed and retained by use of a threaded assembly 60 passing through the support arm inner end 58 and side walls 48-48 of the bracket 42. As the pivot point offered by the fastener assembly 60 is located intermediate the hanger arm 28 and limit block 52 it will be appreciated that when the saddle support arm 40 is positioned in the horizontal position, it will be retained in this use position as its undersurface or bottom wall 62 abuts the top 64 of the limit block 52.

Figure 2:
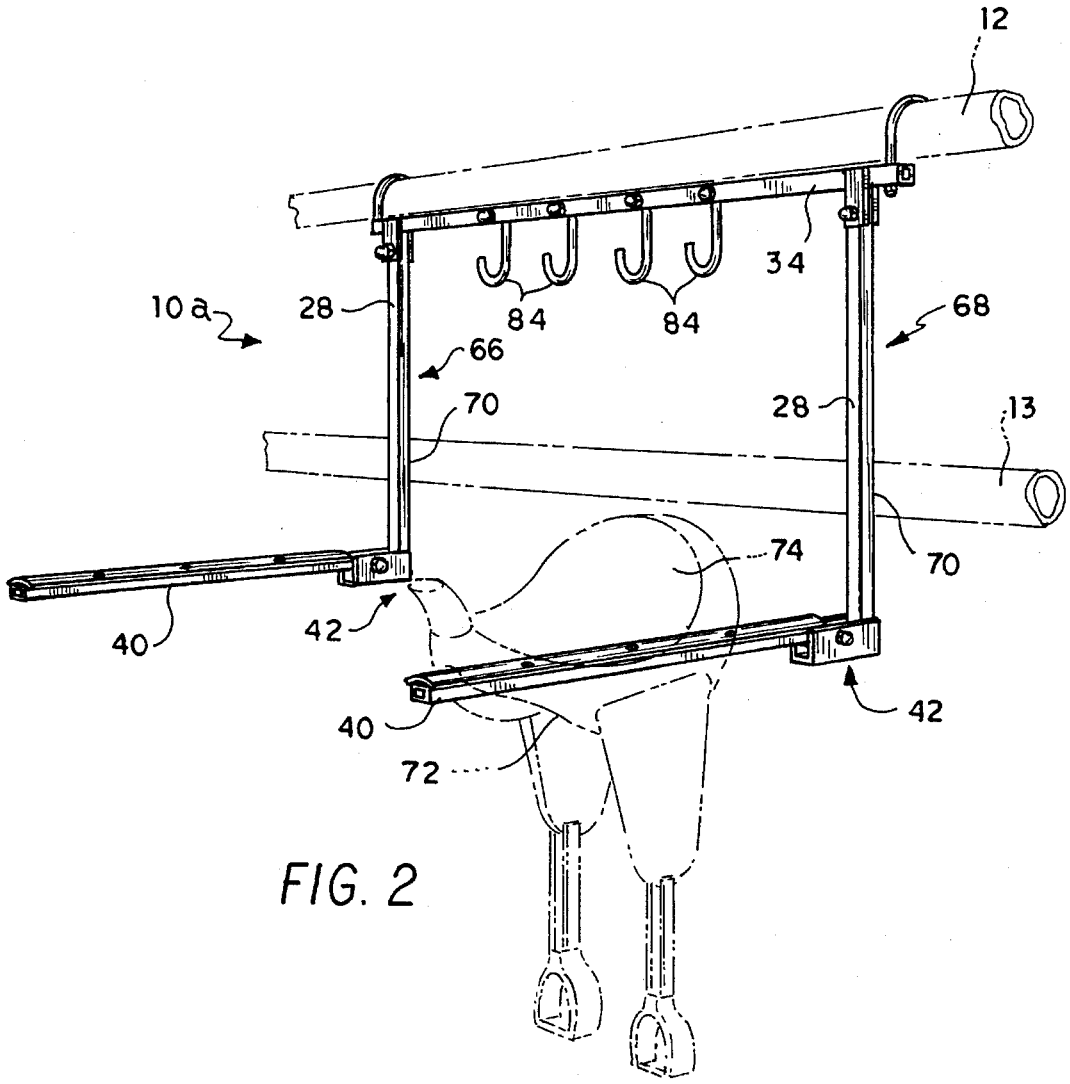
FIG. 2 is a view similar to FIG. 1 but depicts an alternative embodiment for accommodating two saddles.
Figure 3:
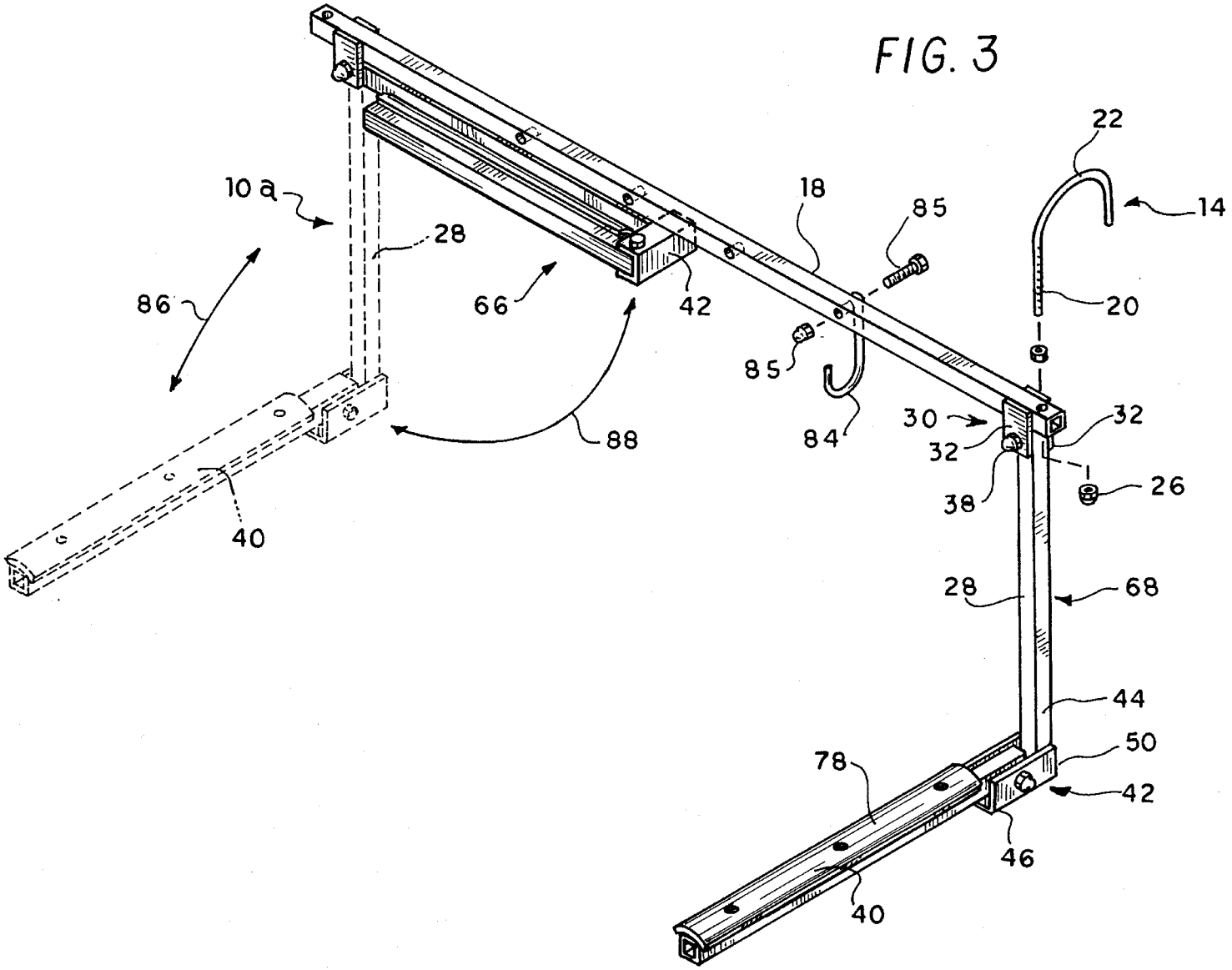
FIG. 3 is an enlarged, partially exploded perspective view of the apparatus of FIG. 2 and illustrates one of the saddle support arms in the collapsed condition.

With the above described structure in mind, the general operation of the rack assembly 10 may be understood. The rack may be configured to accommodate either a single saddle or a pair of saddles without departing from the basic construction as above described. FIG. 1 shown a single saddle version 10 including one hanger arm 28, saddle support arm 40 and connecting retention bracket 42, combining to form a saddle support sub-assembly 66. In the embodiment of FIGS. 2 and 3, a second such saddle support sub-assembly 68 will be seen to be attached adjacent the opposite end 17 of the top member 18, exactly duplicating the structure of the sub-assembly 66, to provide a dual saddle rack 10*a*. In either case, the rack will be seen to be supported simply by engaging the two hanger elements 14-14 over any convenient available structure, such as the top fence rail 12. In this manner, the lower or intermediate area of the rear face 70 of the hanger arm(s) 28 will be seen to abut the next lower fence rail 13 and thus the rack assumes a fixed supported position. Alternatively, if the available structure should comprise a solid board fence, wall or vehicle side wall, the same stability would be offered as the lower end 44 of the hanger arm 28 similarly abuts such structure.

With the saddle support arm(s) 40 positioned as in FIGS. 1 or 2, the rack is ready for use with the length of the support arm 40 no less than the overall length of a saddle seat, for obvious reasons.

Figure 4:
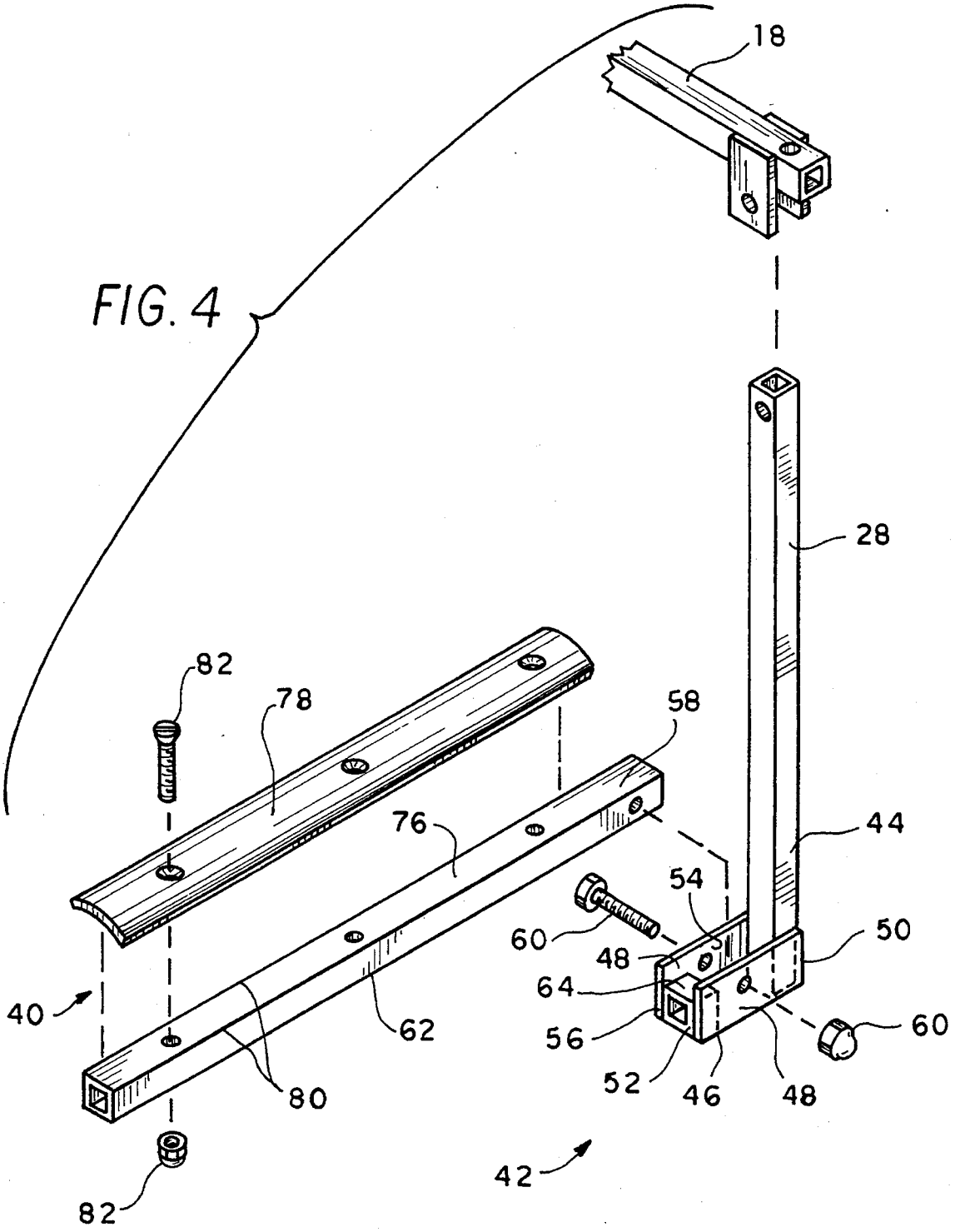
FIG. 4 is a still further enlarged, exploded perspective view depicting the details of one saddle support arm and associated hanger arm.

From a review of FIG. 4, the details of the construction of the saddle support arms 40 will be apparent. To discourage gouging or otherwise damaging the undersurface 72 of a saddle seat 74, the top wall 76 of the support arm 40 is provided with a protective top cover 78 comprising a beveled or concave strip overlying the otherwise exposed sharp edges 80-80 bounding the arm top wall 76. The top cover 78 preferably comprises a plastics composition of any suitable synthetic resinous product, thus presenting a smooth surface offering a low coefficient of friction. Suitable fasteners 82 secure this top cover 78 to the arm top wall 76. The curvature of the top cover 78 not only facilitates the sliding on and off or hanging of a saddle upon the rack but also enhances a more positive seating of the saddle upon the rack as this curvature nests within the longitudinal groove (not shown) often associated with the undersurface 72 of a saddle seat 74.

To allow for accommodating various other accouterments associated with equestrian activities, a plurality of J-hooks 84 are suspended from the top member 18, intermediate the two hanger elements 14-14 and affixed by fastener assemblies 85 as shown most clearly in FIG. 3. With this addition, other tack items such as bridles, halters or harness items may be suspended from the same rack 10 or 10*a*.

Following use of either rack 10 or 10*a*, it is a simple matter to convert the erected assembly of FIGS. 1 and 2 to the collapsed, ready-to-travel condition whereupon the rack may be readily stowed in a small travel tack box or any other storage area available, even under a vehicle seat. The various tubular members of the rack are merely folded about their pivot joints so that the saddle support arm(s) 40 and attached hanger arm(s) 28 are collapsed into a position parallel with and immediately juxtaposed the horizontal top member 18, as shown in the lefthand portion of FIG. 3. In accomplishing this action, the saddle support arm 40 is initially folded in a first plane, from the horizontal use position, to a vertical position, along the arc 86 of FIG. 3. Then, the combined, parallel saddle support arm 40 and hanger arm 28 are moved in unison about the pivot of the fastener assembly 38, in another plane, through the arc 88 of FIG. 3. In the case of the rack 10*a*, the same procedure is followed with the second sub-assembly 68 to complete the collapse of the rack into its stowed position.

From the foregoing, it will be appreciated that an improved saddle rack is provided with a common stock material being used to form all of the principal components of the apparatus and wherein two separate arm members are affixed to a single top member using pivot axes disposed in a 90 degree offset manner such that upon collapsing of the assembly, an outwardly projecting saddle arm is initially folded flush against a hanger arm and subsequently, both folded arms are in turn folded in another plane to a position parallel with and flush against the top member to yield a folded assembly exhibiting the ultimate of compactness.

It will be understood that the present invention is not limited to the embodiments described hereinabove, but encompasses any and all embodiments within the scope of the appended claims.

I claim:

1. A portable saddle rack comprising, an elongated top member, hanger elements on said top member, a hanger arm depending from said top member, a saddle support arm extending substantially horizontally and outwardly from said hanger arm, pivot assemblies movably attaching said hanger arm respectively to said top member and saddle support arm, and said pivot assembly attaching said hanger arm to said top member permitting displacement of said hanger arm in a plane substantially parallel with said top member with said pivot assembly attaching said saddle support arm to said hanger arm permitting displacement of said saddle arm in a plane normal to the displacement plane of said hanger arm.

2. A portable saddle rack according to claim 1 wherein, said top member, hanger arm and saddle support arm comprise rectangular tubing.

3. A portable saddle rack according to claim 1 wherein, said pivot assemblies include a threaded bolt capped by an acorn nut.

4. A portable saddle rack according to claim 1 wherein, said top member includes opposite ends and said hanger elements comprise a pair of upwardly directed hook elements disposed respectively inwardly of said opposite ends.

5. A portable saddle rack according to claim 1 including a plurality of downwardly directed hook elements carried by said top member and disposed intermediate of said hanger elements.

6. A portable saddle rack according to claim 1 wherein, said hanger arm includes opposite upper and lower ends, mounting plates on said top member, and one said pivot assembly connecting said hanger arm upper end to said mounting plates and permitting said hanger arm to swing in a plane substantially parallel to said top member.

7. A portable saddle rack according to claim 1 wherein, said hanger arm includes opposite upper and lower ends, a retention bracket affixed to said hanger arm lower end, and one said pivot assembly connecting said saddle support arm to said retention bracket and permitting said saddle support arm to swing in a plane substantially normal to a vertical plane passing through said top member.

8. A portable saddle rack according to claim 1 including, a pair of said hanger arms depending from said top member contiguous with said hanger elements, and each said hanger arms includes a saddle support arm extending therefrom.

9. A portable saddle rack according to claim 1 including, a plurality of hooks depending from said top member intermediate said hanger elements.

10. A portable saddle rack according to claim 1 including, a top cover affixed to said saddle support arm.

11. A portable saddle rack according to claim 6 including, a retention bracket on said hanger arm lower end, and one said pivot assembly on said saddle support arm carried by said retention bracket.

12. A portable saddle rack according to claim 11 wherein, said retention bracket includes a limit block, and said saddle support arm adapted to abut said limit block and assume a substantially horizontal position extending in a direction away from a vertical plane passing through said top member.

13. A portable saddle rack according to claim 10 wherein, said top cover is convexly curved.

14. A portable saddle rack according to claim 10 wherein, said top cover comprises a synthetic resinous product.

* * * * *